US005628503A

United States Patent [19]

Ishikawa

[11] Patent Number: 5,628,503

[45] Date of Patent: May 13, 1997

[54] PAPER FEEDER

[75] Inventor: Makoto Ishikawa, Tokyo, Japan

[73] Assignee: Riso Kagaku Corporation, Tokyo, Japan

[21] Appl. No.: 352,065

[22] Filed: Nov. 30, 1994

[30] Foreign Application Priority Data

Dec. 6, 1993 [JP] Japan ..... 5-305436

[51] Int. Cl.[6] ..... B65H 5/22

[52] U.S. Cl. ..... 271/4.1; 271/10.04; 271/10.05; 271/10.11; 271/10.13; 271/114

[58] Field of Search ..... 271/10.09, 10.11, 271/10.13, 4.1, 114, 121, 122, 10.04, 10.05; 101/118, 232

[56] References Cited

U.S. PATENT DOCUMENTS 3,961,786 6/1976 Yanker ..... 271/122
5,016,866 5/1991 Takahashi ..... 271/122

FOREIGN PATENT DOCUMENTS 2266517 11/1993 United Kingdom .

OTHER PUBLICATIONS

Patent Abstracts of Japan, vol. 015 No. 142(M-1101), Apr. 10, 1991 Oki Electric Ind., Co., Ltd.; Pat. Date Jan. 31, 1991.

Patent Abstracts of Japan, vol. 013 No. 247(M-835), Jun. 8, 1989 Mita Ind., Co., Ltd.; Pat. Date Mar. 1, 1989 & JP-A-01 053961.

Patent Abstracts of Japan, vol. 008 No. 271(P-320), Dec. 12, 1984 Canon KK; Pat. Date Aug. 11, 1984.

*Primary Examiner*—David H. Bollinger
*Attorney, Agent, or Firm*—Kanesaka & Takeuchi

[57] ABSTRACT

A paper feeder for use in an image forming apparatus for forming images on a printing paper includes a primary paper feeding mechanism which sends out printing sheets one by one at a predetermined speed and a secondary paper feeding mechanism which sends out each of the printing sheets fed from the primary paper feeding mechanism to a printing portion at a speed corresponding to the printing speed of the printing portion. The printing portion is rotated at a speed selected from plural stages of rotational speeds.

9 Claims, 5 Drawing Sheets

PAPER FEEDER

BACKGROUND OF THE INVENTION

1. Field of the Invention

The present invention relates to a paper feeder for use in an image forming apparatus which forms images on printing paper and more particularly to a paper feeder for separating and feeding sheets of printing paper placed on a paper feeding stand.

2. Description of the Belated Art

FIG. 6 is a side view of an image forming apparatus, showing a stencil printer. A stencil obtained by a thermal process is affixed to the outer periphery of a drum 50 which constitutes a printing portion, and printing paper P is fed continuously between the drum 50 and a press roller 50*a* to effect printing in accordance with images on the stencil.

Sheets of printing paper P, which stacked on a paper feeding stand 51, are picked up one by one successively from the top and fed toward the drum 50 by means of a scraper roller 52 and a pickup roller 53, both constituting a primary paper feeding mechanism 57. On the side opposed to the pickup roller 53 are disposed a separator means and an overlap detecting means (neither shown) to separate the paper sheets one by one without overlapping and feed them toward a secondary paper feeding mechanism 58.

Between the drum 50 and the pickup roller 53 is disposed a timing roller 60 which constitutes the secondary paper feeding mechanism 58, and by operation of the timing roller 60, each sheet of printing paper P is fed toward the drum at a predetermined timing which is synchronized to the rotation of the drum 50, and printing is performed.

Thus, the stencil printer is provided with the primary and secondary paper feeding mechanisms 57, 58. The reason why the stencil printer has such two stages of paper feeding mechanisms is that the stencil printer operates at a higher speed in comparison with printers at large, e.g. copying apparatus The primary paper feeding mechanism 57 functions to take out printing sheets P one by one from the paper feeding stand 51 positively without overlapping at a relatively low speed, and the secondary paper feeding mechanism 58 functions to feed the printing sheets P thus taken out to the drum 50 at a high speed corresponding to the rotational speed of the drum which is rotating at a high speed.

In the stencil printer, the printing speed is variable and can be adjusted stepwise from low (e.g. 60 rpm) to high (e.g. 130 rpm).

A belt 66 is stretched among the drum 50 and a plurality of idlers 55 as well as a rotating shaft 65*a* of a motor 65, and by operation of the motor 65, the drum 50 is rotated. The primary and secondary paper feeding mechanisms 57, 58 also utilize the driving force of the motor 65.

The secondary paper feeding mechanism 58 is provided with an intermittent motion mechanism 70. In the intermittent motion mechanism 70, a guide roller cam 71 and a timing roll cam 72 are fixed to the rotating shaft 65*a* of the motor 65, one end 73*a* of a generally sectorial gear 73 is in abutment with the guide roller cam 71, and one end 74*a* of a timing lever 74 is in abutment with the timing roll cam 72.

With rotation of the guide roller cam 71, the sectorial gear 73 moves pivotally about a shaft 73*c* to rotate a guide roller 75 in forward and reverse directions successively, the guide roller 75 being engaged with an opposite end 73*b* of the gear 73.

As the timing roll cam 72 rotates, an opposite end 74*b* of the timing lever 74 moves pivotally in an intermittent manner and urges the timing roller 60 toward the guide roller 75.

When the guide roller 75 rotates in the forward direction, the timing roller 60 is urged toward the guide roller 75 to feed each printing sheet P toward the drum 50 at a predetermined timing.

In the above conventional apparatus, the primary and secondary paper feeding mechanisms 57, 58 are of a merely mechanically coupled construction wherein they are driven by the motor 65 through the belt 66, so when the number of revolutions of the motor 65 is changed upon change in the printing speed, the number of revolutions of the pickup roller 53 in the primary paper feeding mechanism 57 is also changed.

For example, as the printing speed increases, the pickup roller 53 also rotates at a correspondingly high speed, resulting in that it is no longer possible to separate the printing sheets P. More particularly, while the rotating speed of the pickup roller 53 is high, the friction between the roller 53 and the printing sheet P is kept in the state of kinetic friction, so that the pickup roller runs idle with respect to the sheets P and it is impossible to take out the sheets from the paper feeding stand 51.

Thus, a limit is encountered in the speed-up of printing in the image forming apparatus.

As the printing speed decreases, the pickup roller 53 also rotates at a low speed and can separate the printing sheets P and deliver them to the secondary paper feeding mechanism 58. In this case, however, the printing sheets P are apt to overlap each other. The conventional paper feeding mechanism is not provided with means capable of surely preventing the occurrence of such overlapping of printing sheets, although there may be used an overlap detecting means for detecting such overlapping after occurrence.

In both cases mentioned above, it is necessary to prevent the occurrence of the foregoing problems, and particularly it has been desired to provide means which is applicable also to the case where the printing speed is variable.

The present invention has been accomplished in view of the above-mentioned problems and it is the object of the invention to provide a paper feeder capable of separating and feeding printing sheets always stably even upon change in the printing speed in an image forming apparatus of the type wherein the printing speed is variable, and also capable of being constructed easily.

SUMMARY OF THE INVENTION

According to a first aspect in the present invention there is provided a paper feeder for use in an image forming apparatus for forming images on a printing sheet, the paper feeder comprising a primary paper feeding mechanism which sends out printing sheets one by one at a predetermined speed and a secondary paper feeding mechanism which sends out each of the printing sheets fed from the primary paper feeding mechanism to a printing portion at a speed corresponding to the printing speed of said printing portion, the printing portion being rotated at a speed selected from plural stages of rotational speeds.

According to a second aspect in the present invention there is provided a paper feeder comprising a pickup roller which comes into contact with each printing sheet on a paper feeding stand and takes it out from the same stand, a separating roller opposed to the pickup roller and which sends out the printing sheets one by one, a primary motor for rotating the pickup roller intermittently at a constant speed, a secondary motor for rotating a printing portion at a speed selected from plural stages of rotational speeds, and a timing roller connected to the secondary motor and which feeds each printing sheet conveyed thereto by the pickup roller and the separating roller to the printing portion at a speed corresponding to the printing speed of the printing portion.

According to a third aspect in the present invention there is provided a paper feeder as set forth in the second aspect wherein the separating roller is provided with an urging means for urging the separating roller in a rotating direction opposite to the rotating direction adopted for sending out the printing sheets so that in the event of overlap of printing sheets taken out by the pickup roller each printing sheet which has come into contact with the separating roller can be conveyed back in the direction opposite to the printing paper feed direction.

According to a fourth aspect in the present invention there is provided a paper feeder as set forth in the second aspect wherein a clutch for transferring the driving force of the secondary motor to the timing roller or for cutting off the driving force is disposed between the secondary motor and the timing roller, and the timing roller is driven by operating the clutch in accordance with the rotational speed and angle of the printing portion, thereby feeding each printing sheet to the printing portion at a speed corresponding to the printing speed of the printing portion.

The paper feeder feeds printing sheets one by one to the printing portion which is rotated at a speed selected from plural stages of rotation speeds. The paper feeder includes a primary paper feeding mechanism which takes out the printing sheets on the paper feeding stand one by one and a secondary paper feeding mechanism which feeds the printing sheets delivered from the primary paper feeding mechanism at a speed corresponding to the printing speed of the printing portion.

In the primary paper feeding mechanism, the primary motor rotates pitch by pitch by a predetermined angle at a constant speed, whereby the pickup roller and the separating roller are rotated by the predetermined angle. When the printing sheets are conveyed by these rollers, a short interruption time occurs continuously, so that the printing sheets are sure to be separated without overlapping.

The secondary paper feeding mechanism sends out the printing sheets delivered from the primary paper feeding mechanism to the printing portion at a speed corresponding to the printing speed of the printing portion.

DETAILED DESCRIPTION OF THE PREFERRED EMBODIMENT

Figure 1:
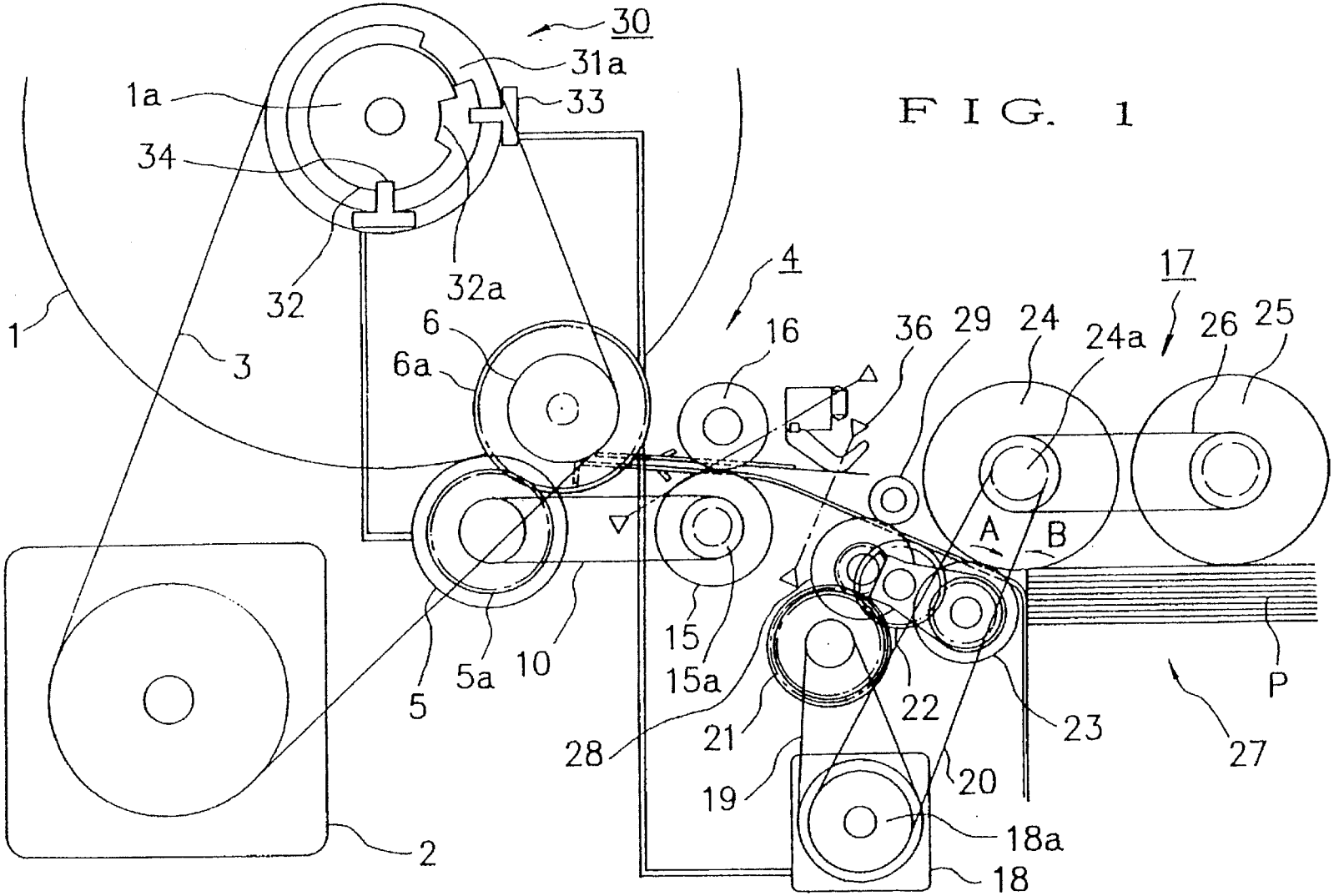
FIG. 1 is a side view showing an image forming apparatus embodying the present invention.

FIG. 1 is a side view of an image forming apparatus embodying the present invention, showing a stencil printer as in the prior art referred to previously.

A rotating shaft la of a drum 1 as a printing portion with stencil affixed thereto is connected to a secondary motor 2 through a belt 3, which belt is also connected to a secondary paper feeding mechanism 4. The rotating speed of the secondary motor 2 can be changed over to any of plural stages of rotational speeds pre-set by a control means (not shown). While the secondary motor 2 operates in accordance with a drive signal provided from a drive means, it causes the drum 1 to rotate continuously at a predetermined speed.

The secondary paper feeding mechanism 4 has a pulley 6 connected to the belt 3 and also has a gear **6*a* fixed coaxially to the pulley 6. The gear 6*a* is in mesh with a gear 5*a* of an electromagnetic clutch 5. A belt 10 is connected to the electromagnetic clutch 5 and is also connected to a shaft 15*a* of a timing roller 15. In opposition to the timing roller 15 is disposed a guide roller 16. By the rotation of the timing roller 15** there is performed a secondary feed of printing paper P.

Figure 2:
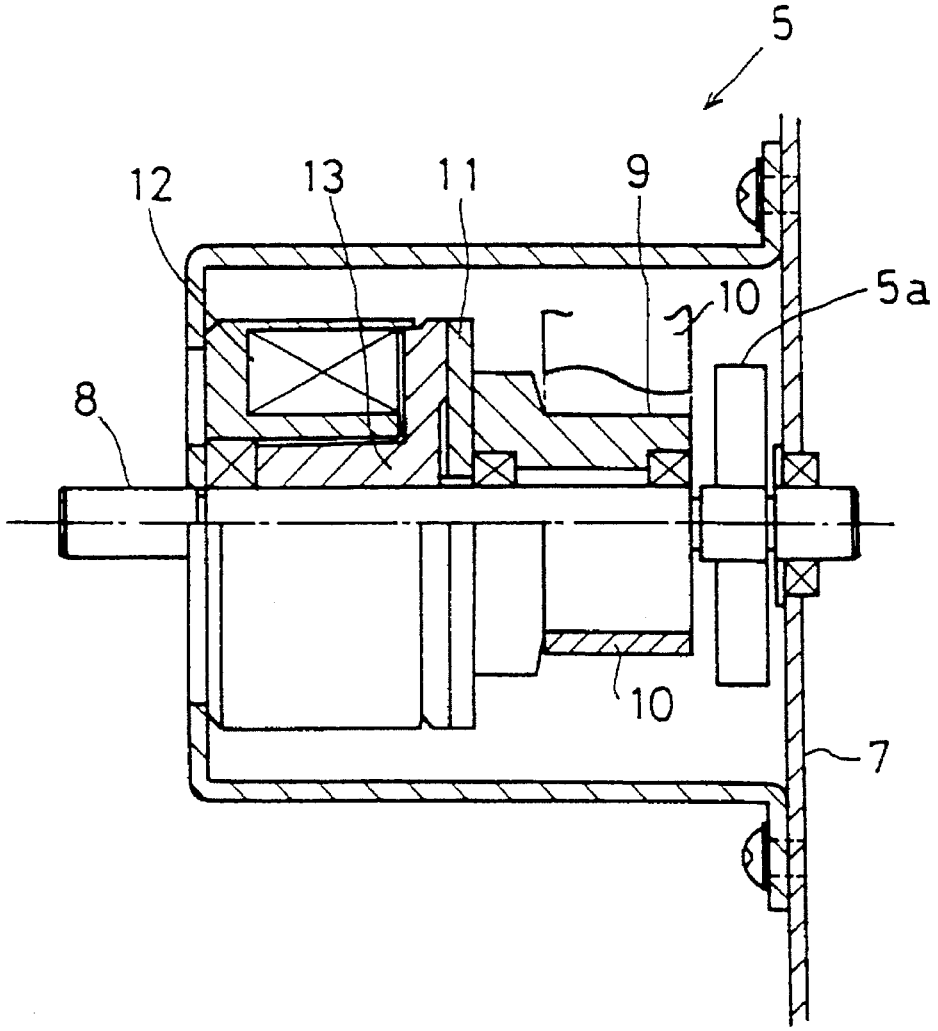
FIG. 2 is a partially cut-away view showing an electromagnetic clutch in a secondary paper feeding mechanism.

FIG. 2 is a partially cut-away view of the electromagnetic clutch 5. As shown therein, a clutch shaft 8 is supported rotatably by a body side plate 7, and the gear **5*a* is fixed to one end portion of the clutch shaft. A pulley 9 is loosely mounted centrally of the clutch 8, and the belt 10 is entrained on the outer periphery of the pulley 9. An armature 11 is fixed to an end portion of the pulley 9**.

Fixed to the opposite end of the clutch shaft 8 is an electromagnetic coil 12, and a rotor 13 is fixed to the clutch shaft portion where the coil 12 is fixed. The rotor 13 attracts the armature 11 of the pulley 9 upon energization of the electromagnetic coil 12 to couple the belt with the clutch shaft 8.

Thus, only when the coil 12 is energized, the timing roller 15 rotates, and in cooperation with the guide roller 16, it feeds the printing paper P toward the drum 1. The transfer path of gear **6*a*→gear 5*a*→pulley 9→belt 10→timing roller 15 has been designed to reduce the speed at a predetermined ratio. When the electromagnetic coil 12 is deenergized, the armature 11 and the roller 13 are spaced from each other, and the timing roller 15** is stopped by means of a brake.

As shown in FIG. 1, a primary paper feeding mechanism 17 uses a primary motor 18 as a drive source. As the primary motor 18 is used a pulse motor adapted to rotate pitch by pitch at a predetermined angle and at a constant speed. Driving pulses are fed from a drive means (not shown).

Belts 19 and 20 are entrained on a rotating shaft **18*a* of the primary motor 18, the belt 19 being connected to a separating roller 23 through intermediate gears 21 and 22**.

A torque limiter (not shown) is incorporated in the separating roller 23 and it is rotatively urged in the direction of arrow A (opposite to a printing paper P feeding direction indicated at B) at all times. The rotating direction of the separating roller 23 at the time of delivery of the printing paper is opposite to the direction A.

The belt 20 is connected to a rotating shaft **24*a* of a pickup roller 24 which is disposed in an opposed relation to the separating roller 23. Likewise, a scraper roller 25 is connected to the pickup roller 24 through a belt 26. Upon operation of the primary motor 18, the pickup roller 24 and the scraper roller 25 deliver the Printing paper P on paper feeding stand 27** in the direction of arrow B.

Between the primary paper feeding mechanism 17 and the secondary paper feeding mechanism 4 are disposed an intermediate feed roller 28 and a pinch roller 29 opposedly to each other. A gear is fixed coaxially to the intermediate feed roller 28 and it is in mesh with the intermediate gear 21 and is given a driving force from the primary motor 18. The intermediate feed roller 28 rotates in the same direction as the separating roller 23 and performs a primary feed of the printing paper P in cooperation with the roller 23.

On the rotating shaft 1*a* of the drum 1 is provided a rotation detecting means 30, as shown in FIG. 1, which is for synchronizing the operation of the primary paper feeding mechanism 17 and that of the secondary paper feeding mechanism 4 to each other relative to the rotation of the drum 1.

More specifically, onto the rotating shaft 1*a* are fixed a primary detector disc 31 having a groove 31*a* and a secondary detector disc 32 having a groove 32*a*, and a primary photointerrupter is provided in an outer peripheral position of the primary detector disc 31, while a secondary photointerrupter 34 is provided in an outer peripheral position of the secondary detector disc 32.

While light is transmitted in the groove 31*a* of the primary detector disc 31 and a detected signal is obtained over a predetermined period in accordance with rotation of the drum 1, the primary motor 18 is allowed to rotate to perform the primary feed operation for the printing paper P.

On the other hand, while light is transmitted in the groove 32*a* of the secondary detector disc 32 and a detected signal is obtained over a predetermined period, the electromagnetic clutch 5 is operated and the secondary paper feed operation for the printing paper is performed by the secondary paper feeding mechanism 4 under continuous rotation of the drum 1.

An operation timing of the primary and secondary paper feeding mechanisms 17, 4 is set on the basis of a fixing angle of the primary and secondary detector discs 31, 32 relative to each other and a reduction ratio in each of the paper feeding mechanisms 17 and 4.

Between the intermediate feed roller 28 and the timing roller 15 is disposed a preresist sensor 36, whereby the position of the printing paper P which has been conveyed by the primary paper feeding mechanism 17 and not reached the secondary paper feeding mechanism 4 yet is detected. The detected signal is outputted to a control means (not shown). Upon lapse of a predetermined time after input of the detected signal the control means controls the delivery end timing of the printing paper P in the primary paper feeding mechanism 17.

Reference will be made below to the paper feeding operation in the above construction.

Upon rotation of the secondary motor 2 at a certain preset printing speed, the drum 1 with stencil affixed thereto rotates through the belt 3, now ready for printing.

In synchronism with the rotation of the drum 1 the primary side photointerrupter 33 of the rotation detecting means 30 causes the primary paper feeding mechanism 17 to operate intermittently. In this case, during operation of the primary motor 18, sheets of printing paper P on the paper feeding stand 27 are taken out one by one and conveyed to the secondary paper feeding mechanism 4.

Figure 3:
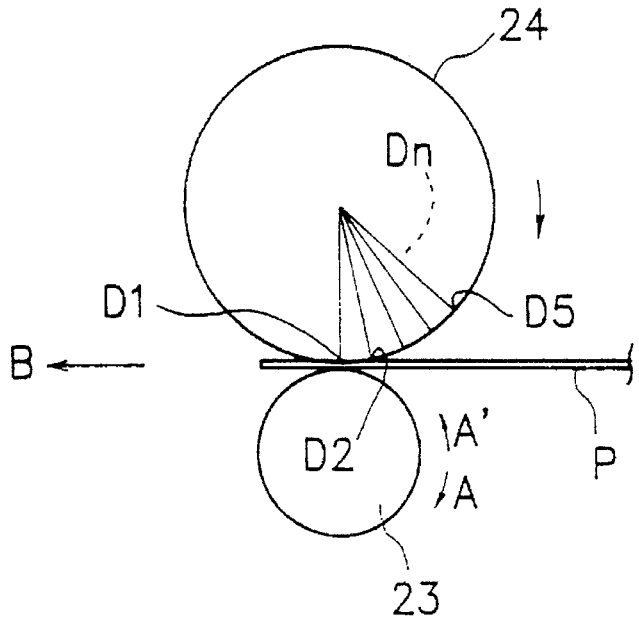
FIG. 3 is an enlarged view showing the operation of a primary paper feeding mechanism.

In this connection, FIG. 3, which is an enlarged view, shows a manner the printing sheets are separated one by one in the primary paper feeding mechanism 17. As shown therein, the primary motor 18 rotates by a predetermined angle at a predetermined speed. Consequently, in the portion of the scraper roller 25 and that of the pickup roller 24 and separating roller 23, the operation is once stopped at each angle. Particularly, when the pickup roller 24 and the separating roller 23 are stopped, there occurs a state of static friction between them and the printing paper P located therebetween. Thus, since a large frictional force can be created against the printing paper P, it is possible to effect paper separation positively.

Further, the pickup roller 24 and the separating roller 23, during rotation thereof, can generate a static friction state similar to the above in a plurality of angular positions against the printing paper P, so even in the event of failure in paper separation in position D1, it is possible to effect the paper separation again in plural positions D2~D5, . . . Dn.

By means of the primary motor 18 which rotates at low and constant speed, the separating roller 23 can effect paper separation always at a constant speed even when the printing speed is high. According to the construction of the apparatus, the separating roller 23 is rotatively urged in the direction of arrow A in the figure, but in the case of conveying a single sheet of printing paper P, the separating roller 23 rotates in the direction of arrow A' (the same direction as the paper delivery direction B) because the urging force of the torque limiter incorporated in the separating roller 23 is set small against the paper conveying force.

Figure 4:
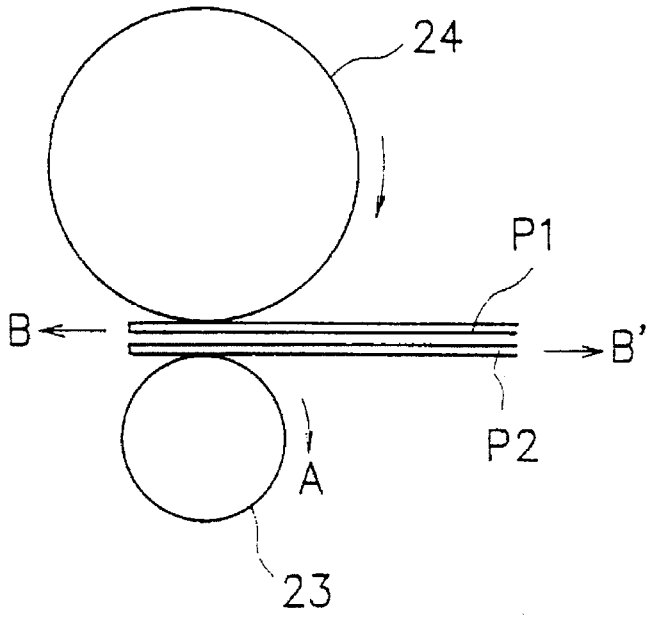
FIG. 4 is an enlarged view showing a manner for preventing overlapping of sheets in the primary paper feeding.

FIG. 4 shows a manner how overlap of paper sheets is prevented in the primary paper feeding mechanism 17. As shown therein, the separating roller 23 is rotatively urged in the direction of arrow A at all times, so in the event two sheets of printing paper P1 and P2 are introduced in an overlapped state between the pickup roller 24 and the separating roller 23, the upper printing sheet P1 which is in contact with the pickup roller 24 can be moved in the direction of arrow B, while the lower printing sheet P2 which is in contact with the separating roller 23 can be moved back in the opposite direction B' onto the paper feeding stand 27.

This is because a friction coefficient M2 between the printing sheets P1 and P2 is the smallest among a friction coefficient M1 of the interface between the pickup roller 24 and the printing sheet P1, the friction coefficient M2 and a friction coefficient M3 between the printing sheet P2 and the separating roller 23. Thus, the printing sheet P1 in contact with the pickup roller 24 can be sent out in the direction of arrow B, while the printing sheet P2 can be moved back in the direction of arrow B' by virtue of the rotating force in the direction of arrow A of the separating roller 23.

In this way, between the pickup roller 24 and the separating roller 23, only one sheet is separated without overlap from the stack of printing sheets P on the stand 17. The printing sheet thus separated can be delivered to the secondary paper feeding mechanism 4 by means of the intermediate feed roller 28 and the pinch roller 29.

Thus, by means of the primary paper feeding mechanism 17, each printing sheet P can be taken stably without overlap and always at a constant, low speed, and is then fed toward the drum 1 at a speed corresponding to the rotating speed of the drum 1 by means of the secondary paper feeding mechanism 4.

Figure 5:
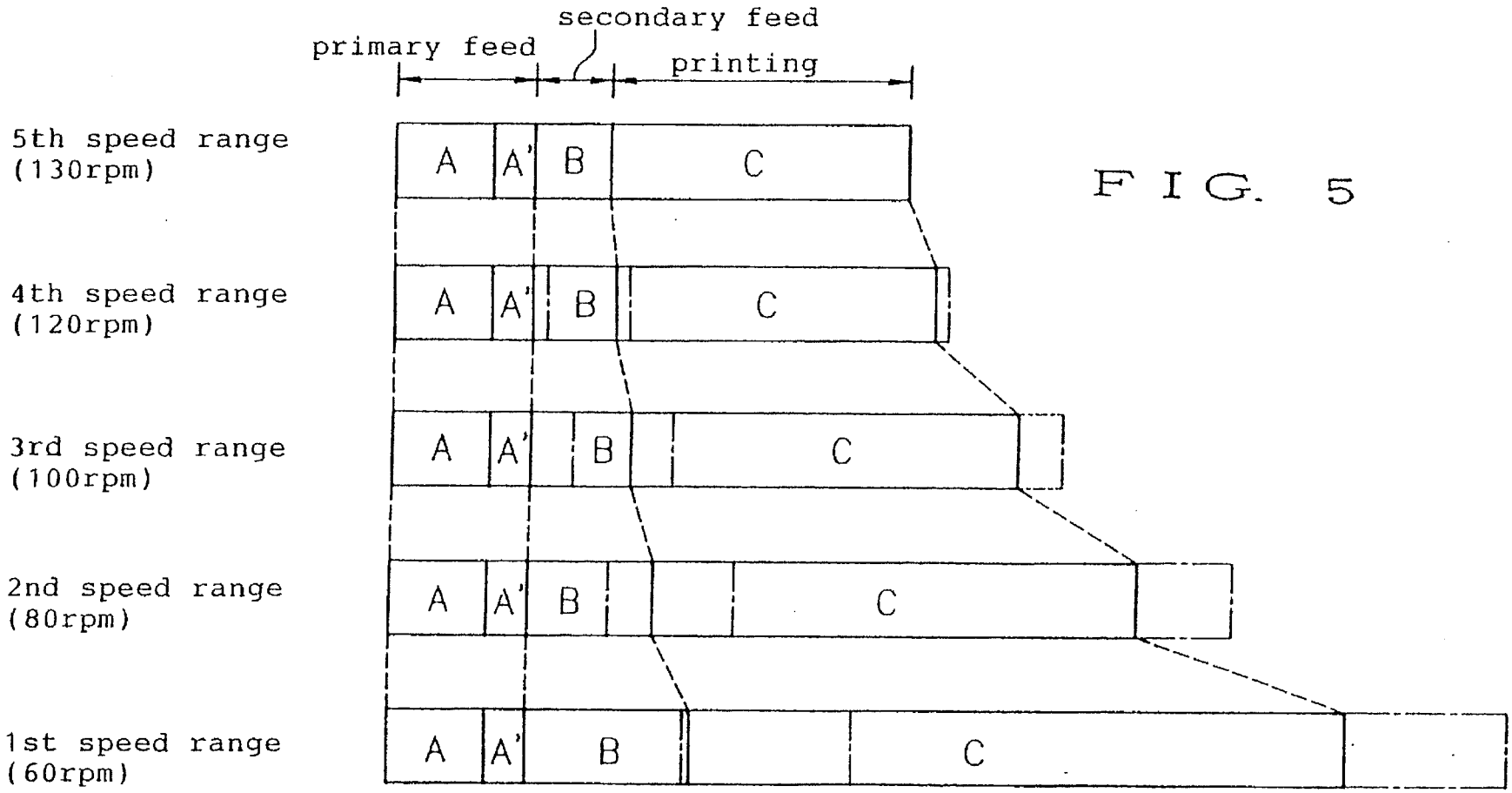
FIG. 5 is a diagram showing times required in various portions of the apparatus.
Figure 6:
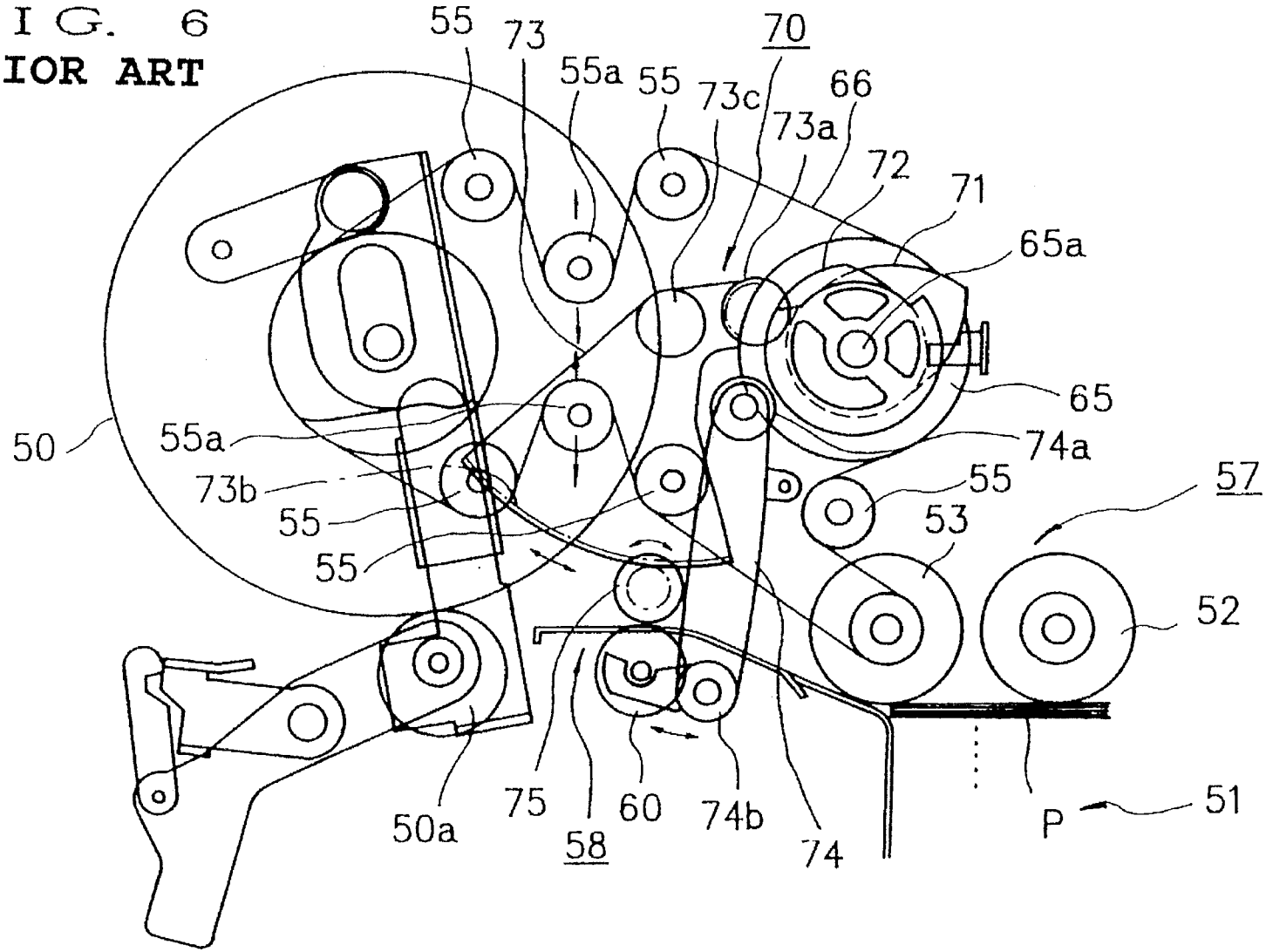
FIG. 6 PRIOR ART
FIG. 6 is a side view showing a conventional paper feeder.

FIG. 5 shows required times for the feed of paper at various printing speeds in the apparatus being considered. The paper feed time (A, A' in the figure) in the portion of the primary paper feeding mechanism 17 is always constant. The reference mark A represents time required for the paper separating operation for the printing paper P in the portion from the separating roller 23 to the intermediate feed roller 28, while A' represents time required for the delivery of the printing paper from the intermediate feed roller 28 to the timing roller 15.

Paper feed time (B in the figure) in the portion of the secondary paper feeding mechanism 4 and the time (C in the figure) required for printing which is performed with rotation of the drum 1, differ according to rotational speeds of the drum.

The delivery speed in the primary paper feeding mechanism 17 is set at a value capable of responding to the maximum rotating speed of the drum 1. By so doing, the paper feed time can be shortened in comparison With the primary paper feed mechanism 17 in the conventional apparatus wherein the primary paper feed time differs depending on the rotational speed of the drum 1 and is long, resulting in the overall time being long, as indicated by a dot-dash line in FIG. 5. From the same figure it is apparent that in the apparatus of this embodiment the required time is shortened particularly at low speed in comparison with the conventional apparatus.

According to the construction of the present invention, since the roller in the primary paper feeding mechanism for taking out each printing sheet from the paper feeding stand rotates pitch by pitch at a predetermined angle and at a constant low speed, the printing sheets can be positively separated one by one without overlapping.

Further, the secondary paper feeding mechanism sends out each printing sheet thus fed at low speed by the primary paper feeding mechanism at a high speed corresponding to a selected one of variable printing speeds in the paper printing portion. Thus, the printing speed can be varied freely while retaining the foregoing paper separating performance, whereby the printing efficiency can be improved.

What is claimed is:

1. A paper feeder for use in an image forming apparatus for supplying printing sheets to a printing portion of the image forming apparatus to form images on the printing sheets, comprising:

a primary paper feeding mechanism for picking up printing sheets one by one, said primary paper feeding mechanism rotating at a constant speed at intermittent intervals while picking up each of the printing sheets; and a secondary paper feeding mechanism situated adjacent to the primary paper feeding mechanism for receiving each of the printing sheets fed from said primary paper feeding mechanism and supplying to the printing portion of the image forming apparatus at a speed corresponding to a printing speed of said printing portion, said printing portion being rotated at a desired speed selected from plural stages of rotational speeds.

2. A paper feeder according to claim 1, wherein one printing sheet picked up by the primary paper feeding mechanism is moved intermittently until said one printing sheet is received by the secondary paper feeding mechanism.

3. A paper feeder according to claim 2, wherein a time for transferring one of the sheets from the primary paper feeding mechanism to the secondary paper feeding mechanism corresponds to a maximum speed in the plural stages of the rotational speeds of the printing portion.

4. A paper feeder for feeding printing sheets on a paper feeding stand to a printing portion one by one, comprising:

a pickup roller which comes into contact with each of the printing sheets on the paper feeding stand and takes it out from said stand;

a separating roller disposed in an opposed relation to said pickup roller and functioning to send out the printing sheets one by one;

a primary motor connected to the pickup roller for rotating said pickup roller at a constant speed at intermittent intervals while said pickup roller is picking up each of the printing sheets;

a secondary motor connected to the printing portion for rotating the printing portion at a desired speed selected from plural stages of rotational speeds; and a timing roller connected to said secondary motor and functioning to feed each printing sheet which has been conveyed thereto at a constant speed at intermittent intervals by both said pickup roller and said separating roller to said printing portion at a speed corresponding to the printing speed of the printing portion selected from the plural stages.

5. A paper feeder according to claim 4, wherein said separating roller is provided with urging means for urging the separating roller in a rotating direction opposite to the rotating direction for sending out the printing sheets so that in case of overlap of printing sheets taken out by said pickup roller, one printing sheet which has come into contact with said separating roller can be conveyed back in a direction opposite to the printing paper feed direction.

6. A paper feeder according to claim 4, wherein a clutch for transferring driving force of said secondary motor to said timing roller or for cutting off said driving force is provided between the secondary motor and the timing roller, and the timing roller is driven by operating said clutch in accordance with the printing of said printing portion, thereby feeding each printing sheet to the printing portion at a speed corresponding to the printing speed of the printing portion.

7. A paper feeder for feeding printing sheets on a paper feeding stand to a printing portion one by one, comprising:

a pickup roller which comes into contact with each of the printing sheets on the paper feeding stand and takes it out from said stand;

a primary motor connected to the pickup roller for rotating said pickup roller at a constant speed at intermittent intervals while said pick roller is picking up each of the printing sheets;

a secondary motor connected to the printing portion for rotating the printing portion at a desired speed selected from plural stages of rotational speeds; and a timing roller connected to said secondary motor and functioning to feed each printing sheet which has been conveyed thereto at a constant speed at intermittent intervals by said pickup roller to said printing portion at a speed corresponding to the printing speed of the printing portion selected from the plural stages.

8. A paper feeder according to claim 7, wherein one printing sheet picked up by the pickup roller is moved intermittently until said one printing sheet is received by the timing roller.

9. A paper feeder according to claim 8, wherein a time for transferring one of the sheets from the pickup roller to the timing roller corresponds to a maximum speed in the plural stages of the rotational speeds of the printing portion.

* * * * *